US008544604B2

(12) United States Patent
Noel

(10) Patent No.: US 8,544,604 B2
(45) Date of Patent: Oct. 1, 2013

(54) ELEVATING PLATFORM ASSEMBLY

(75) Inventor: Gerard Noel, Sainte-Julie (CA)

(73) Assignee: Hydro Mobile Inc., L'Assomption, Quebec (CA)

( * ) Notice: Subject to any disclaimer, the term of this patent is extended or adjusted under 35 U.S.C. 154(b) by 44 days.

(21) Appl. No.: 12/921,973

(22) PCT Filed: Mar. 11, 2009

(86) PCT No.: PCT/CA2009/000296

§ 371 (c)(1),
(2), (4) Date: May 25, 2011

(87) PCT Pub. No.: WO2009/111875

PCT Pub. Date: Sep. 17, 2009

(65) Prior Publication Data

US 2011/0259669 A1 Oct. 27, 2011

(30) Foreign Application Priority Data

Mar. 11, 2008 (CA) ..... 2625313

(51) Int. Cl.
*E04G 1/20* (2006.01)

(52) U.S. Cl.
USPC ..... 182/141

(58) Field of Classification Search
USPC ..... 182/141
See application file for complete search history.

(56) References Cited

U.S. PATENT DOCUMENTS

| | | | | |
|---|---|---|---|---|
| 3,437,174 | A * | 4/1969 | Coblentz et al. | 182/16 |
| 3,924,710 | A * | 12/1975 | Shohet | 187/270 |
| 4,171,033 | A * | 10/1979 | Rust et al. | 182/69.6 |
| 5,555,952 | A * | 9/1996 | van Mol et al. | 182/18 |
| 6,095,285 | A * | 8/2000 | St-Germain | 182/146 |
| 6,250,426 | B1 | 6/2001 | Lombard | |
| 6,523,647 | B2 * | 2/2003 | Duplessis | 187/270 |
| 7,140,467 | B2 | 11/2006 | Cook | |
| 2003/0188922 | A1 * | 10/2003 | Duplessis | 182/18 |
| 2008/0011548 | A1 * | 1/2008 | Lombard | 182/146 |

FOREIGN PATENT DOCUMENTS

| | | |
|---|---|---|
| WO | WO 97/08407 | 3/1997 |
| WO | WO 2007/005122 | 1/2007 |

* cited by examiner

*Primary Examiner* — Alvin Chin Shue
(74) *Attorney, Agent, or Firm* — Faegre Baker Daniels LLP

(57) ABSTRACT

An elevating platform assembly (50) comprises a pair of laterally spaced, generally vertical masts (52). A drive mechanism (100) is coupled to each mast (52) and is moveable upwardly and downwardly along the masts. An elongated elevating platform (58) extends between the masts. A connection frame (150) couples each end of the elevating platform to a respective one of the drive mechanisms (100). Each connection frame (150) is pivotally coupled to the drive mechanism (100).

24 Claims, 3 Drawing Sheets

ELEVATING PLATFORM ASSEMBLY

CROSS-REFERENCE TO RELATED APPLICATION

This application is related to and claims the benefit under 35 U.S.C. §119 and 35 U.S.C. §365 of International Application No. PCT/CA2009/000296, filed Mar. 11, 2009, the disclosure of which is expressly incorporated herein by reference.

TECHNICAL FIELD

The present invention relates generally to elevating working platform assemblies and in particular to an elevating platform assembly suitable for use in single mast and twin mast environments.

BACKGROUND ART

Elongated working platforms are well known in the art and are commonly used during construction to support workers and equipment at desired elevations. Working platforms of this nature include for example, stationary scaffolding as well as moveable elevating platform assemblies. Although stationary scaffolding is useful, in many instances it is desired to change quickly the elevation of workers and equipment and thus, elevating platform assemblies are advantageous.

One known type of elevating platform assembly is disclosed in U.S. Pat. No. 6,523,647 to Duplessis and assigned to Hydro-Mobile Inc. of L'Assomption, Quebec, Canada assignee of the subject application. This elevating platform assembly comprises an elongated platform that is supported at one end by a mast. A drive mechanism acts between the elongated platform and the mast. The drive mechanism includes a trolley moveable along the mast to which the elongated platform is secured. A motor is mounted on the trolley and drives one or more pinions that cooperate with a rack secured to the mast. In this manner, the elongated platform can be moved upwardly and downwardly along the mast.

The above elevating platform assembly has also been used in a dual mast configuration as shown in FIG. 1. In this environment, an elevating platform 10 spans a pair of laterally spaced masts 12. Each end of the elevating platform 10 is coupled to the drive mechanism on a different one of the masts 12. In order to move the elevating platform 10 upwardly and downwardly along the masts 12, an operator on each mast must control the motor on the trolley that is moveable along that mast so that the drive mechanism 14 remains generally in the same horizontal plane as the drive mechanism on the other mast thereby to ensure that the elevating platform 10 remains level. As will be appreciated, operating the drive mechanisms 14 on the masts 12 separately while maintaining the elevating platform 10 in a level horizontal condition is a difficult task. To permit the drive mechanisms 14 to be vertically spaced, at least to some extent, adaptors 20 acting between each end of the elevating platform 10 and the drive mechanisms 14 on the masts 12 have been employed.

As can be seen in FIG. 1, the connections between the adaptors 20 and the drive mechanisms 14 are such that the portions of the elevating platform that surround the masts 12 remain generally horizontal even though the elevating platform 10 maybe at an angle to the horizontal. Although the movement of the adaptors 20 helps to reduce strain applied to the elevating platform 10 when drive mechanisms 14 deviate from the horizontal, when the angle of the elevating platform

10 deviates from the horizontal by a certain extent one adaptor 20 pulls on the other. This results in point loads identified by arrows 22 generally centered at the adaptors 20 being created and an unwanted horizontal force applied to the masts 12. Also, movement of the adaptors 20 results in movement of the guard rails on the adaptors. As a result, sections of guard rails may overlap or gaps between guard rails may occur causing potential safety concerns. Improvements are therefore desired.

It is therefore an object of the present invention to provide a novel elevating platform assembly suitable for use in single mast and twin mast environments.

DISCLOSURE OF THE INVENTION

Accordingly, in one aspect there is provided an elevating platform assembly comprising:

a generally vertical mast;

a drive mechanism coupled to said mast and being moveable upwardly and downwardly along said mast;

an elongated elevating platform extending from said mast; and a connection frame coupling said elevating platform to said drive mechanism, said connection frame being fixedly secured to said drive mechanism to maintain said elevating platform in a generally horizontal orientation in a single mast configuration and being pivotally coupled to said drive mechanism in a dual mast configuration.

In one embodiment, the connection frame comprises at least one support pin. The at least one support pin rests on a support surface of the drive mechanism and is moveable along the support surface. Typically, the connection frame comprises a pair of oppositely extending support pins with each support pin resting on an associated support surface on the drive mechanism. Each surface is formed on a resting block carried by the drive mechanism and is concave. The elevating platform assembly may further comprise releasable locking structure to inhibit pivotal movement of the connection frame relative to the drive mechanism. In one form, the locking structure comprises one of an anti-rotation pin and anti-backlash fastener acting between the connection frame and the drive mechanism.

According to another aspect there is provided an elevating platform assembly comprising:

a pair of laterally spaced, generally vertical mast;

a drive mechanism coupled to each mast and being moveable upwardly and downwardly along said mast;

an elongated elevating platform extending between said masts; and a connection frame coupling each end of said elevating platform to a respective one of said drive mechanisms, each connection frame being pivotally coupled to said respective drive mechanism.

BRIEF DESCRIPTION OF THE DRAWINGS

Embodiments will now be described more fully with reference to the accompanying drawings in which.

BEST MODE FOR CARRYING OUT THE INVENTION

Figure 1:
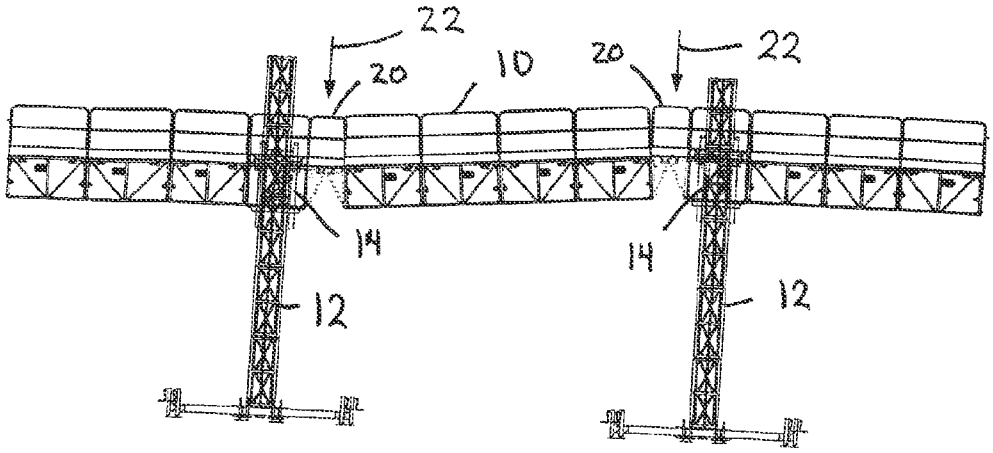
(Prior Art) Fig. 1
FIG. 1 is a rear elevational view of a prior art elevating platform assembly.
Figure 2:
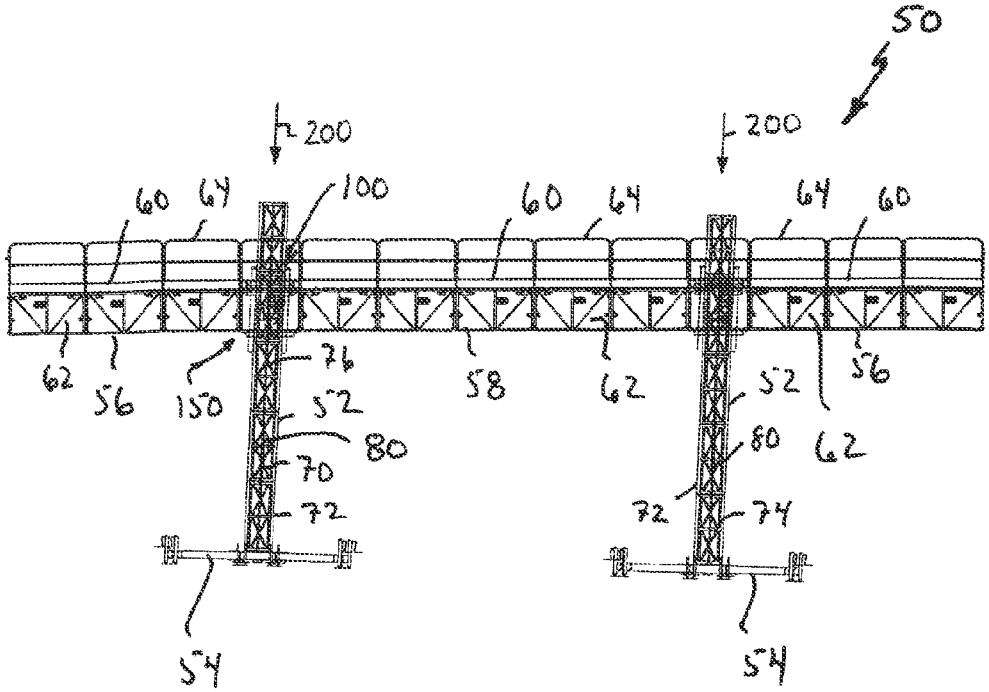
FIG. 2 is a rear elevational view of an elevating platform assembly.
Figure 3:
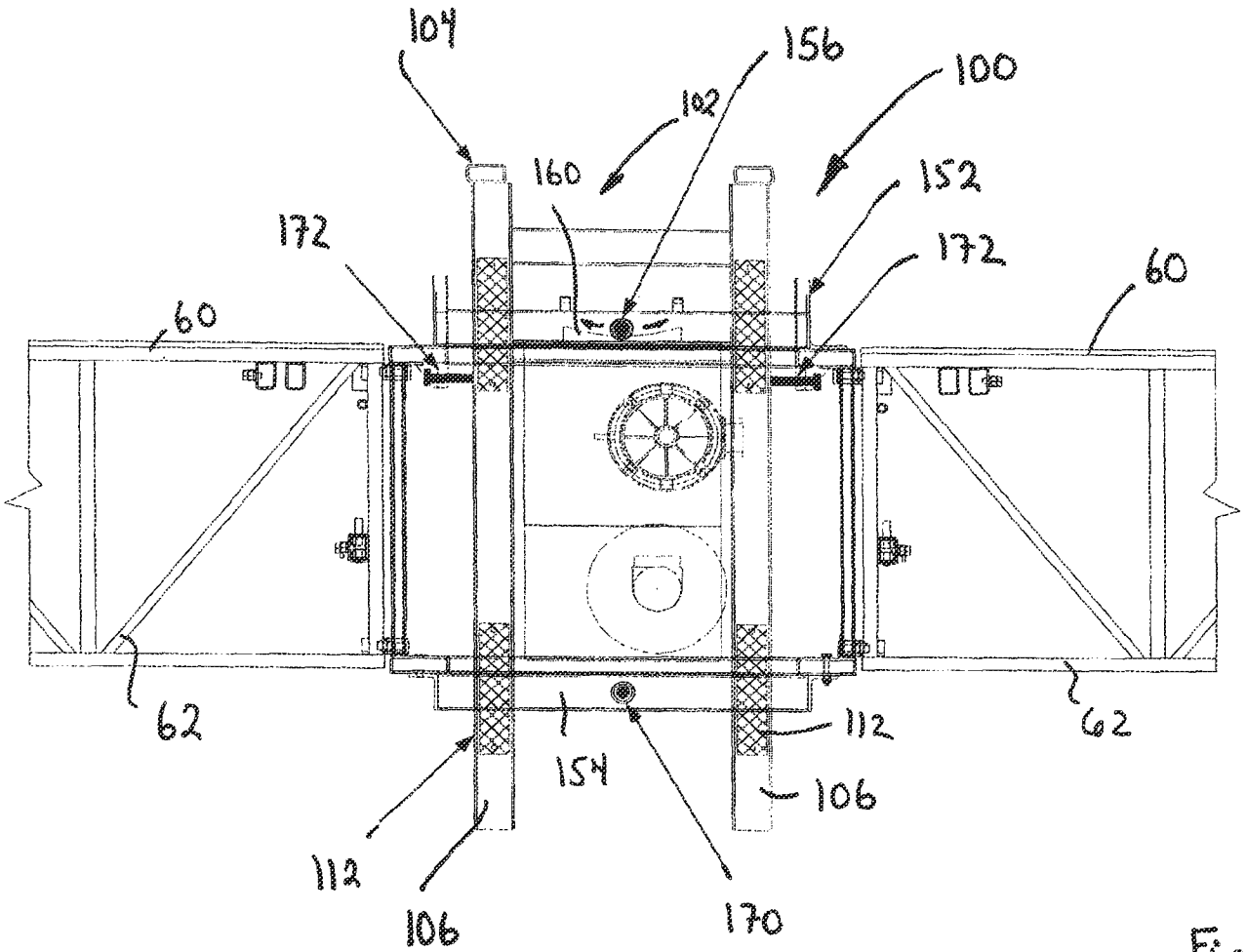
FIG. 3 is an enlarged rear elevational view of a portion of the elevating platform assembly of FIG. 2.
Figure 4:
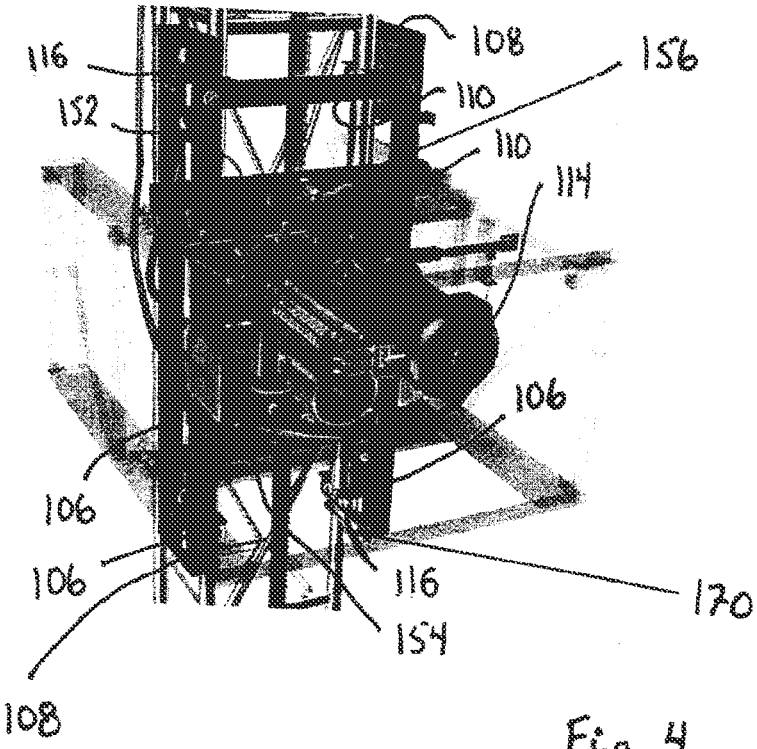
FIG. 4 is a perspective view of a portion of the elevating platform assembly of FIG. 2.

Referring now to FIGS. 2 to 4, a twin mast elevating platform assembly is shown and is generally identified by reference numeral 50. As can be seen, elevating platform assembly 50 includes a pair of laterally spaced, generally vertical masts 52, each of which is supported by a base assembly 54 resting on a ground surface or other suitable support surface. An elongate platform 56 extends from one side of each mast 52 generally at a right angle. An elongate platform 58 also extends between the masts 52. Each elongate platform 56, 58 includes a generally planar work surface 60 secured to an underlying supporting framework 62. Guard rails 64 surround the work surface 60, and are fixed in position such that no relative motion occurs between adjacent guard rails 64 during operation. The elongate platforms 56, 58 are coupled to the masts 52 in a manner that permits the elongate platforms to move vertically along the masts 52 thereby to allow the work surface 60 to be positioned at desired elevations.

Each mast 52 is formed from a series of stacked, box-type mast sections 70 and includes four vertical corner rails 72 joined by horizontal crossbars 74 at vertically spaced locations. A plurality of diagonal cross-members 76 extends between the rails 72 and the horizontal crossbars 74 to provide additional support to the mast 52. A vertical rack 80 is secured to the horizontal crossbars 74 on one side of the mast 52 by suitable fasteners (not shown).

A drive mechanism 100 that is responsive to control signals from a user control panel is provided on each mast 52. Each drive mechanism 100 acts between the elongate platforms 56 and 58 and the rack 80 and includes a trolley 102 moveable along the mast 12. The trolley 102 comprises a box-like frame 104 having four corner uprights 106 joined by horizontal beams 108 and 110. The two uprights 106 closest to the mast 52 carry guides 116 that partially surround the adjacent corner rails 72 of the mast to facilitate movement of the frame 104 along the mast. Antifriction pads 112 are provided on each upright 106 at vertically spaced locations. A motor 114 is mounted on the frame 104 and drives one or more pinions that cooperate with the rack 80 on the mast 52.

A box-like connection frame 150 surrounds each mast 52. One side of the connection frame 150 is fastened to one end of the elevating platform 56 and the other side of the connection frame 150 is fastened to one end of the elevating platform 58. The connection frame 150 includes upper and lower, generally horizontal beams 152 and 154 that pass through the trolley frame 104. The upper beam 152 carries a pair support pins 156 each of which extends from an opposite side of the upper beam. Each support pin 156 sits on a respective shallow concave resting block 160 mounted on a respective horizontal beam 110 of the trolley frame 104. The support pins 156 may be discrete elements extending from opposite sides of the upper beam 152 or may be defined by opposite ends of a single element that extends through and is secured to the upper beam 152.

Figure 5:
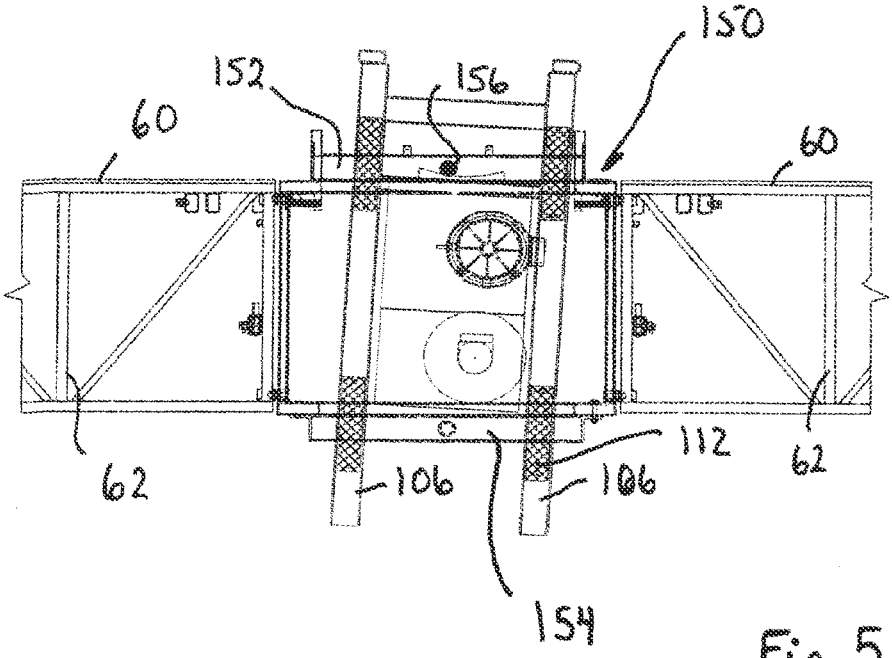
FIG. 5 is another enlarged rear elevational view of a portion of the elevating platform assembly of FIG. 2 in a pivoted position.

During operation of the elevating platform assembly 50, when the drive mechanisms 100 become vertically spaced, as the elevating platforms 56 and 58 move with the drive mechanisms 100, the support pins 156 move along the upper surfaces of the resting blocks 160 allowing the connection frames 150 to pivot relative to the masts 52 as shown in FIG. 5. In this manner, resulting point loads are generally centered on the axes of the masts 52 as indicated by arrows 200 in FIG. 2 eliminating horizontal forces and moments of force from being applied to the masts 52. Also, as guard rails 64 are fixed relative to each other, no openings or pinch points are created between adjacent guard rails 64 during operation. The anti-friction pads 112 on the uprights 106 facilitate pivoting of the connections frames 150.

During set up of the elevating platform assembly 50 to connect the elevating platforms 56 and 58 to the masts 52, for each connection frame 150, an anti-rotation pin 170 is passed through aligned holes in the connection frame 150 and the trolley frame 104 to inhibit the connection frame 150 from rotating relative to the mast 52. Anti-backlash fasteners 172 in the form of screws are also passed through the connection frames 150 to engage the trolley frames 104. Once the elevating platforms 56, 58 have been connected, the anti-rotation pins 170 and anti-backlash fasteners 172 are removed. Anti-rotation pins 170 and anti-backlash fasteners 172 thereby provide locking structure for the connection frame 150 and the drive mechanism 100.

If the elevating platform assembly 50 is to be used in a single mast configuration with one or more elevating platforms extending horizontally from the mast, the anti-rotation pins and anti-backlash fasteners are left in position thereby to inhibit the connection frame 150 from rotating relative to the mast.

Although an embodiment has been described with reference to the accompanying drawings, those of skill in the art will appreciate that modifications and variations may be made without departing from the spirit and scope thereof as defined by the appended claims.

What is claimed is:

1. An elevating platform assembly comprising:

a generally vertical mast;

a drive mechanism coupled to said mast and being moveable upwardly and downwardly along said mast;

an elongated elevating platform extending from said mast; and a connection frame coupling said elevating platform to said drive mechanism, said connection frame being fixedly secured to said drive mechanism to maintain said elevating platform in a generally horizontal orientation in a single mast configuration and being pivotally coupled to said drive mechanism in a dual mast configuration, wherein the connection frame comprises at least one support pin, said at least one support pin resting on a generally concave support surface of said drive mechanism and being moveable along said support surface.

2. An elevating platform assembly according to claim 1 wherein said support surface is formed on a resting block carried by said drive mechanism.

3. An elevating platform assembly according to claim 1 wherein said connection frame comprises a pair of oppositely extending support pins, each support pin resting on an associated generally concave support surface of said drive mechanism and being moveable along said associated support surface.

4. An elevating platform assembly according to claim 3 wherein each support surface is formed on a respective resting block carried by said drive mechanism.

5. An elevating platform assembly according to claim 1 further comprising releasable locking structure to inhibit pivotal movement of said connection frame relative to said drive mechanism.

6. An elevating platform assembly according to claim 5 wherein said locking structure comprises at least one of an anti-rotation pin and an anti-backlash fastener acting between said connection frame and said drive mechanism.

7. An elevating platform assembly according to claim 3 further comprising releasable locking structure to inhibit pivotal movement of said connection frame relative to said drive mechanism.

8. An elevating platform assembly according to claim 7 wherein said locking structure comprises at least one of an anti-rotation pin and an anti-backlash fastener acting between said connection frame and said drive mechanism.

9. An elevating platform assembly comprising:

a pair of laterally spaced, generally vertical masts;

a drive mechanism coupled to each mast and being moveable upwardly and downwardly along said mast;

an elongated elevating platform extending between said masts; and a connection frame coupling each end of said elevating platform to a respective one of said drive mechanisms, each connection frame being pivotally coupled to said respective drive mechanism, wherein each connection frame comprises at least one support pin, said at least one support pin resting on a generally concave support surface of said respective drive mechanism and being moveable along said support surface.

10. An elevating platform assembly according to claim 9 wherein each support surface is formed on a resting block carried by said respective drive mechanism.

11. An elevating platform assembly according to claim 9 wherein each connection frame comprises a pair of oppositely extending support pins, each support pin resting on an associated generally concave support surface of said respective drive mechanism and being moveable along said support surface.

12. An elevating platform assembly according to claim 11 wherein each support surface is formed on a respective mounting block carried by said respective drive mechanism.

13. An elevating platform assembly according to claim 9 further comprising releasable locking structure to inhibit pivotal movement of each connection frame relative to said respective drive mechanism.

14. An elevating platform assembly according to claim 13 wherein said locking structure comprises at least one of an anti-rotation pin and an anti-backlash fastener acting between each connection frame and said respective drive mechanism.

15. An elevating platform assembly according to claim 11 further comprising releasable locking structure to inhibit pivotal movement of each connection frame relative to said drive mechanism.

16. An elevating platform assembly according to claim 15 wherein said locking structure comprises at least one of an anti-rotation pin and an anti-backlash fastener acting between each connection frame and said respective drive mechanism.

17. An elevating platform assembly comprising:

a generally vertical mast;

a drive mechanism coupled to said mast and being moveable upwardly and downwardly along said mast;

an elongated elevating platform extending from said mast; and a connection frame coupling said elevating platform to said drive mechanism, said connection frame being fixedly secured to said drive mechanism to maintain said elevating platform in a generally horizontal orientation in a single mast configuration and being pivotally coupled to said drive mechanism in a dual mast configuration, wherein said connection frame comprises a pair of oppositely extending support pins, each support pin resting on an associated support surface of said drive mechanism and being moveable along said associated support surface.

18. An elevating platform assembly according to claim 17 wherein each support surface is formed on a respective resting block carried by said drive mechanism.

19. An elevating platform assembly according to claim 17 further comprising releasable locking structure to inhibit pivotal movement of said connection frame relative to said drive mechanism.

20. An elevating platform assembly according to claim 19 wherein said locking structure comprises at least one of an anti-rotation pin and an anti-backlash fastener acting between said connection frame and said drive mechanism.

21. An elevating platform assembly comprising:

a pair of laterally spaced, generally vertical masts;

a drive mechanism coupled to each mast and being moveable upwardly and downwardly along said mast;

an elongated elevating platform extending between said masts; and a connection frame coupling each end of said elevating platform to a respective one of said drive mechanisms, each connection frame being pivotally coupled to said respective drive mechanism, wherein each connection frame comprises a pair of oppositely extending support pins, each support pin resting on an associated support surface of said respective drive mechanism and being moveable along said support surface.

22. An elevating platform assembly according to claim 21 wherein each support surface is formed on a respective mounting block carried by said respective drive mechanism.

23. An elevating platform assembly according to claim 21 further comprising releasable locking structure to inhibit pivotal movement of each connection frame relative to said respective drive mechanism.

24. An elevating platform assembly according to claim 23 wherein said locking structure comprises at least one of an anti-rotation pin and an anti-backlash fastener acting between each connection frame and said respective drive mechanism.

* * * * *